US005230616A

United States Patent [19]

Serizawa et al.

[11] Patent Number: 5,230,616

[45] Date of Patent: Jul. 27, 1993

[54] ROTARY COMPRESSOR WITH SHAFT BALANCERS

[75] Inventors: Yukio Serizawa, Tochigi; Osami Matsushita, Ibaraki; Motohiro Shiga, Hitachi; Masatsune Sutou, Ota; Hiroaki Hata, Tochigi; Koichi Sekiguchi, Tochigi; Yuukichi Nakada, Tochigi, all of Japan

[73] Assignee: Hitachi, Ltd., Tokyo, Japan

[21] Appl. No.: 440,209

[22] Filed: Nov. 22, 1989

[30] Foreign Application Priority Data

Dec. 5, 1988 [JP] Japan ..... 63-305987

[51] Int. Cl.[5] ..... F04C 18/356

[52] U.S. Cl. ..... 418/151; 29/901; 29/888.024; 29/888.025; 74/352; 418/63

[58] Field of Search ..... 418/63, 98, 151; 74/352; 29/901, 888.024, 888.025

[56] References Cited

U.S. PATENT DOCUMENTS 1,733,821 10/1929 Pontis ..... 74/573
1,811,542 6/1931 Fankboner ..... 74/573
3,074,293 1/1963 Langsetmo ..... 74/573
4,710,111 12/1987 Kubo ..... 418/63
4,915,554 4/1990 Serizawa et al. ..... 418/151

FOREIGN PATENT DOCUMENTS 59-107984 7/1984 Japan .

*Primary Examiner*—Richard A. Bertsch
*Attorney, Agent, or Firm*—Antonelli, Terry Stout & Kraus

[57] ABSTRACT

A rotary compressor has an electric motor and a compressing mechanism drivingly connected together by a crank shaft and disposed in a closed housing. The compressing mechanism has a rolling piston rotatable in a cylinder bore and driven by an eccentric portion of the crank shaft. First, second and third balancers are mounted on an end of the crank shaft and on the opposite ends of a motor rotor, respectively. The second and third balancers are formed therein with weight-adjusting holes by which the masses of the second and third balancers are finely adjusted to fall within tolerable ranges.

2 Claims, 14 Drawing Sheets

ROTARY COMPRESSOR WITH SHAFT BALANCERS

BACKGROUND OF THE INVENTION

1. Field of the Invention

The present invention relates to a rotary compressor and, more specifically, to a compressor of the type having an electric motor and a compressing mechanism drivingly connected together by a crank shaft.

2. Description of the Prior Art

A conventional rotary compressor such as one shown in FIG. 13 has an electric motor 1 and a compressing mechanism 2 connected together by a crank shaft 10. A closed housing 14 accommodates these members.

The electric motor 1 is disposed in the closed housing 14 at an upper portion thereof and comprises a rotor 1*a* and a stator 1*b*. The crank shaft 10 has one end thereof fitted in the rotor 1*a* and drivingly connected at the other end to the compressing mechanism 2.

The compressing mechanism 2 comprises a cylinder block 3 fixed to an inner peripheral surface of the closed housing 14; a roller 4 constituting a rolling piston which is rotatably fitted on an eccentric portion 10*a* of the crank shaft 10, with the eccentric portion being positioned in a cylinder bore 3*a* formed in the cylinder block 3; a vane 5 capable of reciprocating as the roller 4 rotates about the axis of the crank shaft 10; main and auxiliary bearings 6 and 7 mounted on the cylinder block 3 in such a manner so as to close the upper and lower ends of the cylinder bore 3*a*, respectively, while supporting the crank shaft 10; a discharge valve 9 provided on the auxiliary bearing 7; and a cover 8 covering the discharge valve 9.

The compressor is equipped with balancing weights (hereinafter referred to as "balancers") for cancelling an offset force generated by the eccentric rotation of the rolling piston 4. These balancers comprise a first balancer 11-1 mounted on the end of the crank shaft 10 adjacent the auxiliary bearing 7, a second balancer 11-2 mounted on the lower end of the rotor 1*a* of the electric motor 1, and a third balancer 11-3 mounted on the upper end of the rotor 1*a*. The first balancer 11-1 is covered with a cover 12.

In FIG. 14 the amount $M_0R_0$ of unbalance in the eccentric portion 10*a* of the crank shaft 10 is the total of values each obtained by multiplying the mass of each of the rotary portions of the eccentric portion 10*a* by its distance from the center of gravity.

$M_1R_1$ is the total of values each obtained by multiplying the mass of each of the portions of the first balancer 11-1 by its distance from the center of gravity and is called an amount of balance. Similarly, $M_2R_2$ is the amount of balance of the second balancer 11-2, and $M_3R_3$ is the amount of balance of the third balancer 11-3.

As shown in FIG. 14, the respective axial distances from the position of the unbalance amount $M_0R_0$ to the first, second and third balancers 11-1, 11-2 and 11-3 are represented by l1, l2 and l3, respectively.

Balance in forces is achieved in the manner expressed by the following equation:

$$M_0R_0+M_3R_3=M_2R_2+M_1R_1 \quad (1)$$

Balance in moments is achieved in the manner expressed by the following equation:

$$M_1R_1 \cdot l1+M_3R_3 \cdot l3=M_2R_2 \cdot l2 \quad (2)$$

Balance in the primary vibration mode shown in FIG. 15 is achieved in the manner expressed by the following equation:

$$A_1 \cdot M_1R_1+A_2 \cdot M_2R_2=A_0 \cdot M_0R_0+A_3 \cdot M_3R_3 \quad (3)$$

where $A_0$, $A_1$, $A_2$ and $A_3$ express the coefficients of the primary vibration mode.

From the above three equations, the unknown balance amounts $M_1R_1$, $M_2R_2$ and $M_3R_3$ can be calculated.

The above-described balancers in the crank shaft system are employed when the compressor operates at a frequency close to the primary critical speed of the shaft system. The balance amounts of these balancers are so determined as to cancell the primary vibration mode, i.e., the primary deflection mode.

The above-described structure is disclosed in Japanese Utility Model Unexamined Publication No. 59-107984.

The above-described prior art, however, gives no consideration to variations between individual balancer members. That is, when the tolerance level is determined in view of mass-productivity, variations may occur in the balance amounts of the balancers. Factors which can cause such variations include variations in the dimensions and density of the balancers per se, variation in the mounting angle caused during the mounting thereof, and variation in the amount of deformation caused during the assembly thereof.

Furthermore, variations may occur between rotors 1*a* of individual electric motors 1 in the level of eccentricity of their centers of gravity. Since the mass of the rotor 1*a* is relatively great, such variations can greatly influence shaft vibration.

FIG. 16 shows the deflection of the crank shaft determined in the case where the influence of the above-described various variation factors is taken into consideration. The one-dot-chain line 100 indicates the curve along which the axis of the crank shaft 10 deflects when the associated balancers and the associated rotor have no variations and are at the medians of their respective design values (the set values). The solid lines 101 and 102 indicate two different deflection curves of the axis of the crank shaft 10 obtained when there is an influence by variations. It will be understood from FIG. 16 that, when the amount of deflection is observed at the upper end of the rotor 1*a*, the deflection amount which results from variations is δ1 or δ2, whereas the amount of deflection is substantially negligible when the above-mentioned component parts are at the median values.

If deflection amounting to δ1 or δ2 occurs, the crank shaft 10 is inclined in the shaft hole of the main bearing 6 to cause a one-sided engagement therewith. This leads to a problem that such component parts as the main bearing 6 and the crank shaft 10 become worn to an abnormal extent. Another problem is that the deflection of the axis of the crank shaft 10 increases the level of vibration of the entire compressor to an abnormal extent.

FIG. 17 is a graph showing data useful to compare the vibration value, i.e., the vibration acceleration, of a crank shaft with balance amounts at the medians of the set values, and the vibration value of another crank shaft with balance amounts greatly varying from the set values. The vibration value of the first crank shaft is indicated by the solid line with circles therealong, while that of the second crank shaft is indicated by the broken line with squares therealong. As will be clearly understood from the graph, the crank shaft with great variations encounters a rapid increase in the vibration acceleration as its speed of rotation increases.

SUMMARY OF THE INVENTION

The present invention has been accomplished to overcome the above-described problems of the prior art. It is therefore an object of the present invention to provide a rotary compressor in which variation in the balance of the crank shaft system is minimized and the deflection of the crank shaft axis is reduced to assure a high level of reliability and a low level of vibration.

The rotary compressor according to the present invention comprises an electric motor, a compressing mechanism and a crank shaft connecting the electric motor and the compressing mechanism together. The electric motor has a rotor. A first end of the crank shaft is connected to the rotor, while a second end of the crank shaft extends through the compressing mechanism. The compressing mechanism has a cylinder block formed therein with a cylinder bore, a rolling piston rotatably mounted on an eccentric portion of the crank shaft which is positioned in the cylinder bore, a vane reciprocably movable by the rotation of the rolling piston, and main and auxiliary bearings closing the ends of the cylinder bore and rotatably supporting the crank shaft. The compressor further includes a balancer means to balance force generated by eccentric rotation of the crank shaft. The balancer means includes a first balancer mounted on the second end of the crank shaft, and a second balancer mounted on at least a first end of the rotor of the electric motor. At least the second balancer is formed therein with at least one small hole by which the mass of the second balancer is finely adjusted.

Thus, in the rotary compressor of the present invention, the balancer associated with the rotor of the electric motor, which is the most dominant cause of variation among various variation factors, is formed therein with at least one small hole so as to have its mass finely adjusted. It is therefore possible to achieve, in a compressor which may be manufactured by a mass-production system, practically sufficient reliability of bearings and low-vibration operation of the compressor.

In a preferred embodiment of the present invention, the electric motor, the compressing mechanism and the crank shaft are disposed within a closed housing to form a closed-type compressor. A third balancer is mounted on a second end of the rotor of the electric motor, the third balancer being formed therein with a mass-adjusting small hole.

In the preferred embodiment of the present invention, the mass of the balancer means is finely adjusted such that the deviation of the mass of the balancer for the rotor from the value set for the rotor balancer is not more than ±3%.

The balance amounts for the first, second and third balancers may preferably be set at balance amounts greater by a certain value than the balance amounts that assure the 100% achievement of balance in forces, balance in moments and balance in the primary vibration mode.

The above and other objects, features and advantages of the present invention will become more apparent from the following description made with reference to the accompanying drawings.

DESCRIPTION OF PREFERRED EMBODIMENTS

Figure 1:
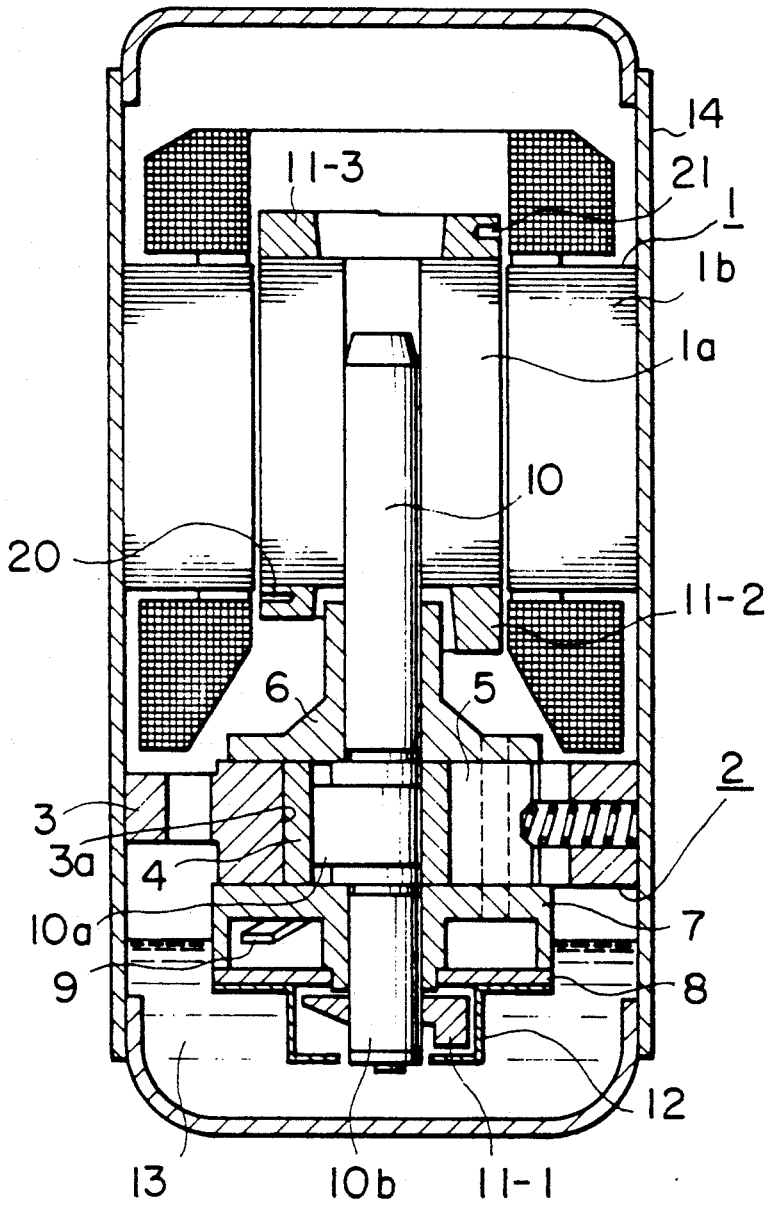
FIG. 1 is a longitudinal section of one embodiment of the rotary compressor according to the present invention.
Figure 13:
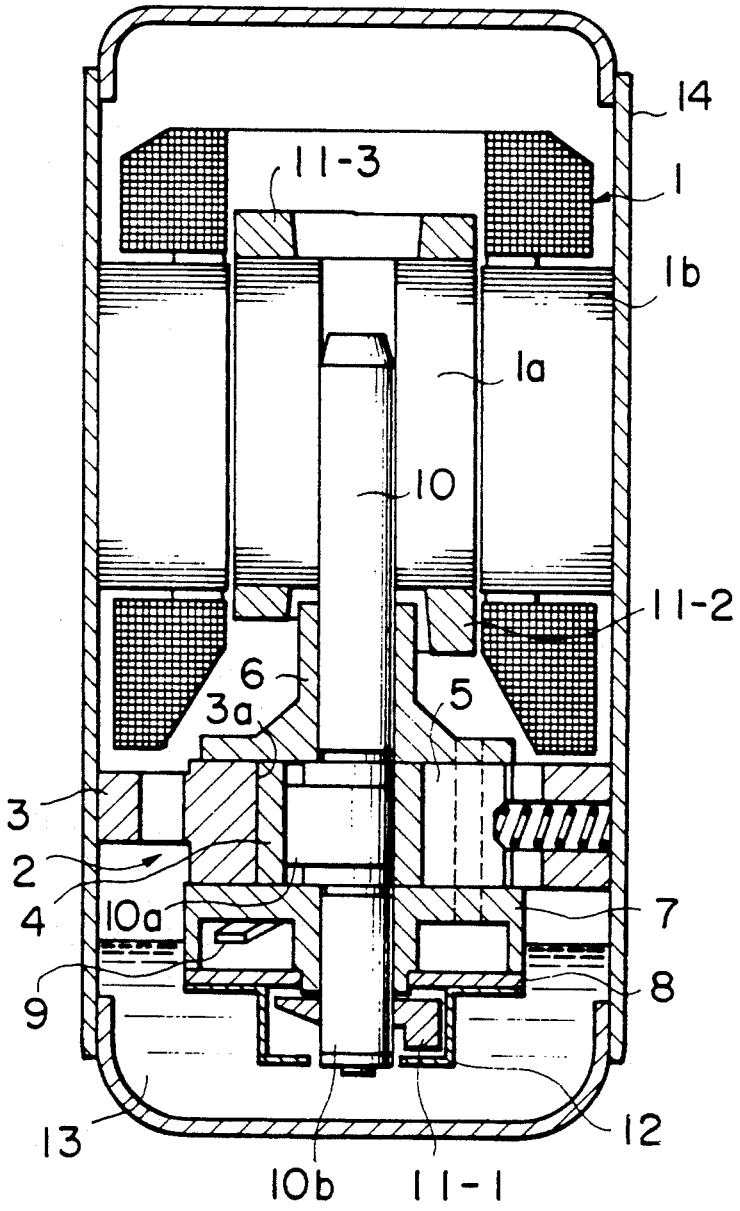
FIG. 13 PRIOR ART
FIG. 13 is a longitudinal section of a conventional, generally-used rotary compressor.
Figure 14:
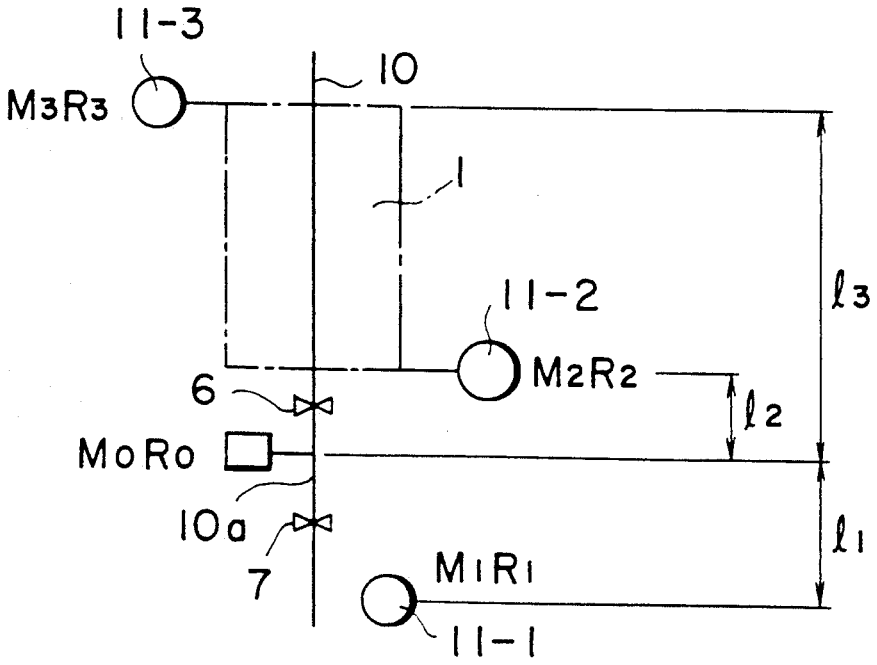
FIG. 14 PRIOR ART
FIG. 14 is a view schematically showing the balance of the crank shaft of the conventional compressor shown in FIG. 13.
Figure 15:
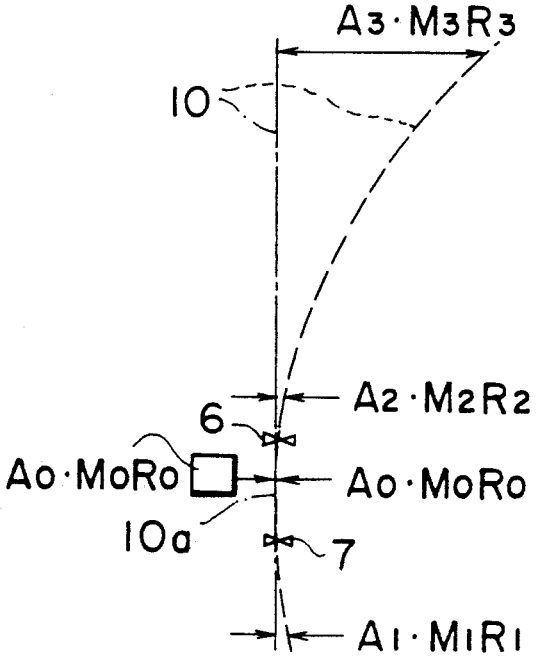
FIG. 15 PRIOR ART
FIG. 15 is a view schematically showing the primary vibration mode of the crank shaft of the conventional compressor.

Those component parts denoted in FIG. 1 by the same reference numerals as those in FIG. 13 are the same or equivalent to those of the prior art. The overall structure of the rotary compressor shown in FIG. 1 is basically the same as that of the prior art shown in FIG. 13 and, therefore, will not be described in detail.

In the embodiments of the present invention, a second balancer 11-2 mounted on the lower end of the rotor 1*a* of the electric motor 1 and a third balancer 11-3 mounted on the upper end of the rotor 1*a* are formed therein with required numbers of small holes 20 and 21, respectively, at the required positions to finely adjust the masses of these balancers 11-2 and 11-3 and reduce the variations of the balancer masses from their respective set values, so that the masses of the balancers 11-2 and 11-3 fall within tolerable ranges.

Figure 2:
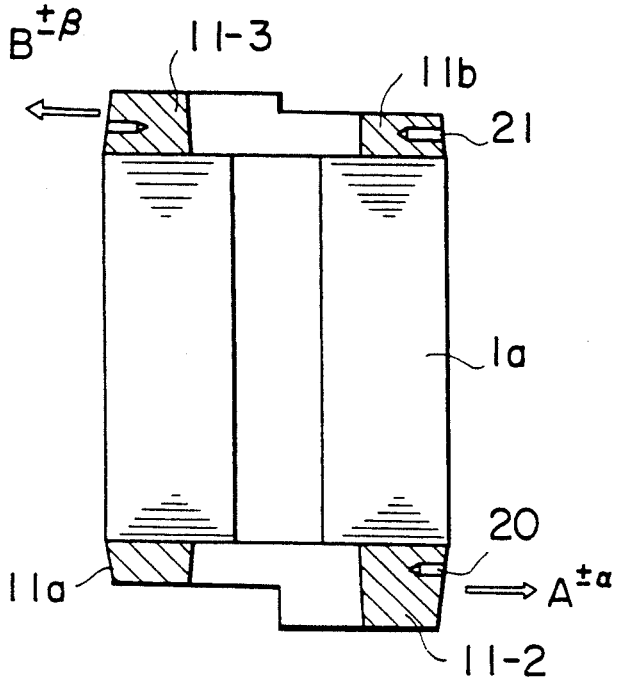
FIG. 2 is a longitudinal section of a rotor of the compressor shown in FIG. 1.
Figure 3:
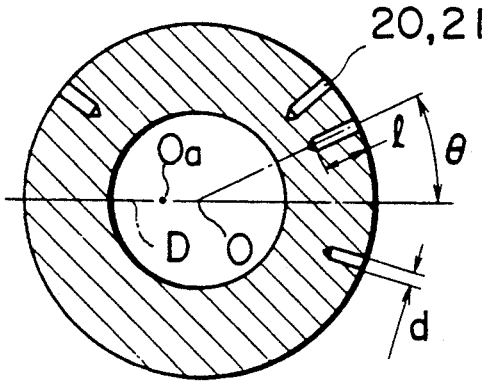
FIG. 3 is a cross-section of an end ring of the rotor shown in FIG. 2.

FIGS. 2 and 3 show the manner in which the mass-adjusting small holes 20 and 21 are formed.

The second and third balancers 11-2 and 11-3 also serve as end rings 11*a* and 11*b* of the rotor 1*a*. Each of the end rings 11*a* and 11*b* is formed therein with a plurality of mass-adjusting small holes 20 or 21, each extending radially inwardly. In order to finely adjust the masses of the balancers 11-2 and 11-3, the angle $\theta$ of each small hole relative to a reference line D passing through the axis 0 of crank shaft 10 and the axis 0*a* of the eccentric portion 10*a*, as well as the length (depth) l and the diameter d of each small hole are selected. A balancing machine is used to repeatedly conduct measurements and drillings of the small holes as many times as required. Mass adjustment is performed in such a manner that the thus achieved masses result in the balance amounts MR (indicated by arrows in FIG. 2) falling within tolerable ranges of their respective set vales ($A \pm \alpha$) and ($B \pm \beta$). Symbols A and B used here represent the respective medians of the set vales ($A \pm \alpha$) and ($B \pm \beta$), while $\alpha$ and $\beta$ represent the allowances.

The dimensions l and d as well as the angle $\theta$ of each of the small holes 20 and 21 and the number of the small holes 20 and 21 vary in compliance with the manufactured states of individual rotors. The small holes 20 and 21 may preferably be formed in the end rings 11*a* and 11*b* so as to allow the small holes to be formed at any angle in the entire or 360° circumference thereof.

Figure 4:
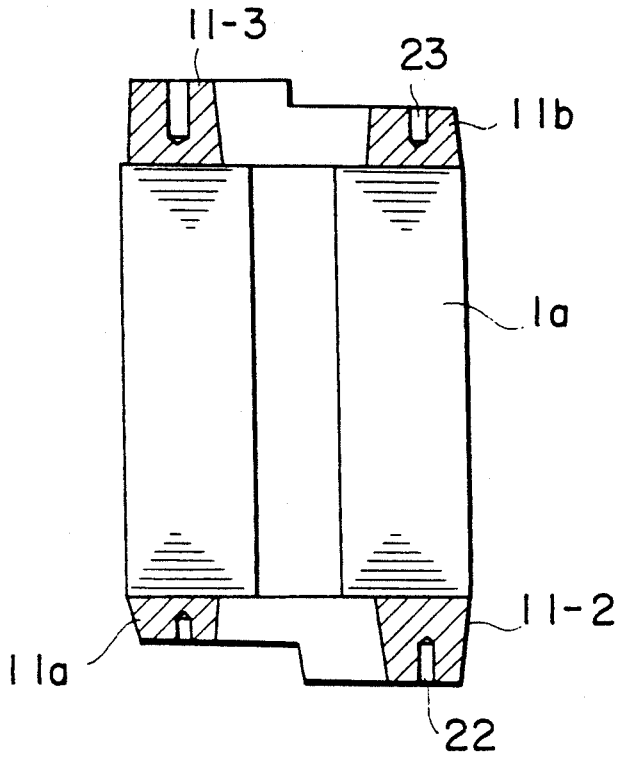
FIG. 4 is a longitudinal section of a rotor of another embodiment of the present invention.
Figure 5:
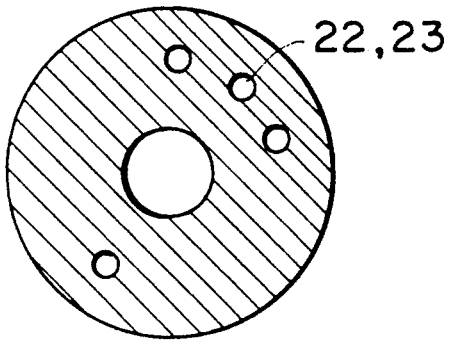
FIG. 5 is a cross-section of an end ring of the rotor shown in FIG. 4.

In another embodiment shown in FIGS. 4 and 5, small holes 22 and 23 for finely adjusting the masses are formed in the axial direction in end rings 11*a* and 11*b*, respectively, the rings being integral with second and third balancers 11-2 and 11-3, respectively.

Although not shown, the small holes may comprise, if required, a combination of axial holes and radial holes.

Next, a descriptions will be made of the way in which the set values of the balance amounts (MR) of the three balancers are calculated.

The three equations (1), (2) and (3) described before in relation to FIG. 13 are solved and, then, the balance amounts $M_1R_1$, $M_2R_2$ and $M_3R_3$ of the first, second and third balancers 11-1, 11-2 and 11-3 are calculated from the following equations (4), (5) and (6), respectively:

$$M_1R_1 = \frac{(A_2 - A_3)l3 + (A_3 - A_0)(l3 - l2)}{(A_2 - A_3)(l3 + l1) - (l1 - l3)(l3 - l2)} \times M_0R_0 \quad (4)$$

$$M_2R_2 = \frac{l3}{l3 - l2} \cdot M_0R_0 - \frac{l3 + l1}{l3 - l2} \cdot M_1R_1 \quad (5)$$

$$M_3R_3 = M_2R_2 + M_1R_1 - M_0R_0 \quad (6)$$

The primary vibration mode coefficients $A_0$ to $A_3$ can be calculated from vibration mode calculations.

As discussed before, when balancers are mass-produced, the balance amounts of the balancers may greatly deviate from their respective set values due to the accumulation of various variations caused by such variation factors as the dimensions and the density of the balancers per se, the mounting dimensions and the mounting angle determined during the mounting thereof, the amount of deformation caused during the assembly thereof, and the eccentricity of the center of gravity of the associated rotor.

Table 1, given below, shows the degree to which such variation factors influence the balance of moments when no balance correction is effected. It will be understood from this table that the influence of the eccentricity of the center of gravity of the rotor is dominant.

TABLE 1

| | DEGREE (%) OF INFLUENCE ON BALANCE OF MOMENTS |
|---|---|
| ECCENTRICITY OF CENTER OF GRAVITY OF ROTOR | 77 |
| TOTAL OF FACTORS SUCH AS DIMENSIONS, DENSITY, DEFORMATION, & MOUNTING DIMENSIONS | 23 |

The data shown in Table 1 is obtained when the percentages at which the balance amounts deviate due to each of the variation factors such as dimensions, density, deformation, and mounting dimensions are approximately 3%, while the percentages at which the balance amounts deviate from the set values due to the eccentricity of the center of gravity of the rotor are ±25%. The rotor of the electric motor can cause a great deviation because the mass of the rotor is particularly great and the center of gravity may offset from the geometrical center since the rotor is a structure formed by an iron core, aluminum bars, aluminum end rings and permanent magnets. The above-mentioned deviation of ±25% is a value ascertained by examining the actual values of typical mass-produced products.

The allowance of the variation attributable to the eccentricity of the center of gravity of the rotor must be determined from the viewpoint of both the prevention of abnormal wear due to one-sided engagement of the crank shaft to the bearing and the prevention of a rapid increase in the vibration value during high-speed rotation.

Figure 6:
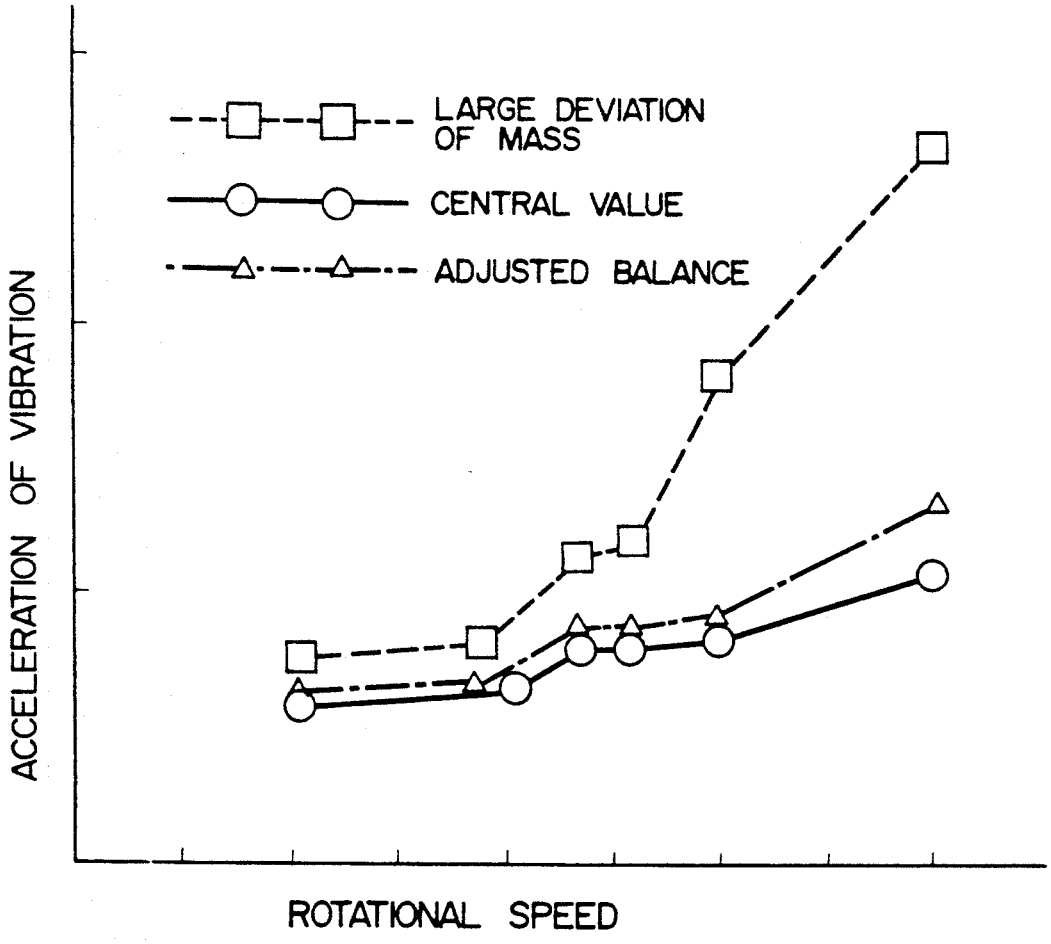
FIG. 6 is a graph showing the results of tests on the relationship between the speed of rotation of the crank shaft and the vibration acceleration.

FIG. 6 is a graph showing change in the vibration acceleration of the crank shaft with change in its speed of rotation. Data on a crank shaft with balance amounts at the medians of the set values is indicated by the solid line with circles therealong, while data on a crank shaft with balance amounts greatly varying from the set values is indicated by the broken line with squares therealong. Data on a crank shaft whose balance is corrected according to the present invention is indicated by the one-dot-chain line with triangles therealong.

The balance-corrected crank shaft shown in FIG. 6 is connected with a rotor whose balance amounts (MR) deviate from the medians of the set values by not more than ±3%. The mass of each of the balancers used is finely adjusted in such a manner that the great variation of ±25% conventionally occurred and ascertained from the actual values of typical mass-produced products is reduced to be not more than ±3%.

It will be understood from FIG. 6 that, by virtue of the above-described balance-correction, the vibration acceleration does not rapidly increase during high-speed rotation.

When tests were conducted concerning the high-speed durability of a rotary compressor incorporating such a balance-corrected rotor, no abnormal wear of the bearings occurred and good results were obtained.

Figure 7:
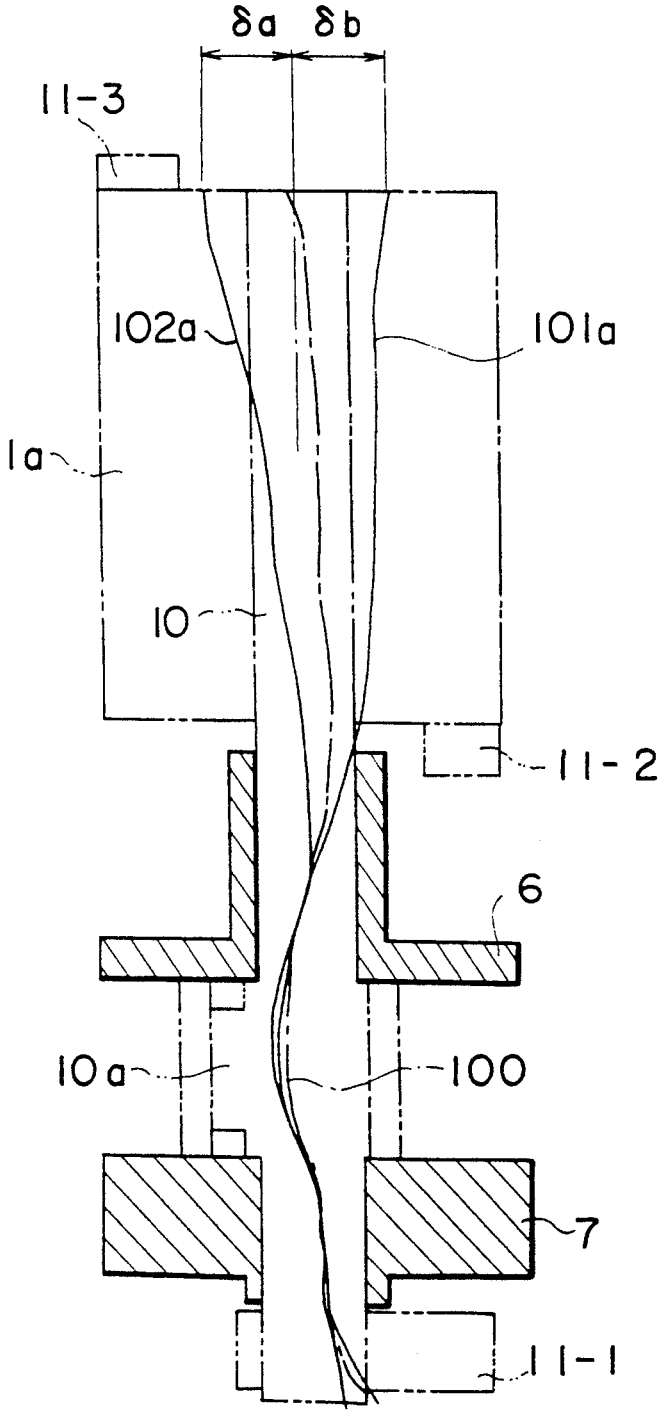
FIG. 7 is a view showing the deflection curves of the axis of the crank shaft of either of the embodiments shown in FIGS. 1 to 5.

As described above, according to the described embodiments of the present invention, the small holes 20 and 21 are respectively formed in the second and third balancers 11-2 and 11-3 so as to finely adjust the individual masses of the balancers. Consequently, the deflection amount $\delta$ of the axis of the crank shaft is reduced remarkably, as shown in FIG. 7.

The reduction in the deflection amount of the axis of the crank shaft in turn assures the prevention of abnormal wears of the crank shaft as well as the main and auxiliary bearings 6 and 7, thereby improving the reliability. The reduction in the deflection of the axis also prevents the rapid increase in the vibration acceleration during high-speed operation.

Next, descriptions will be made with reference to FIGS. 8 to 12 concerning an arrangement which may preferably be employed in determining the set values of the balance amounts.

Figure 8:
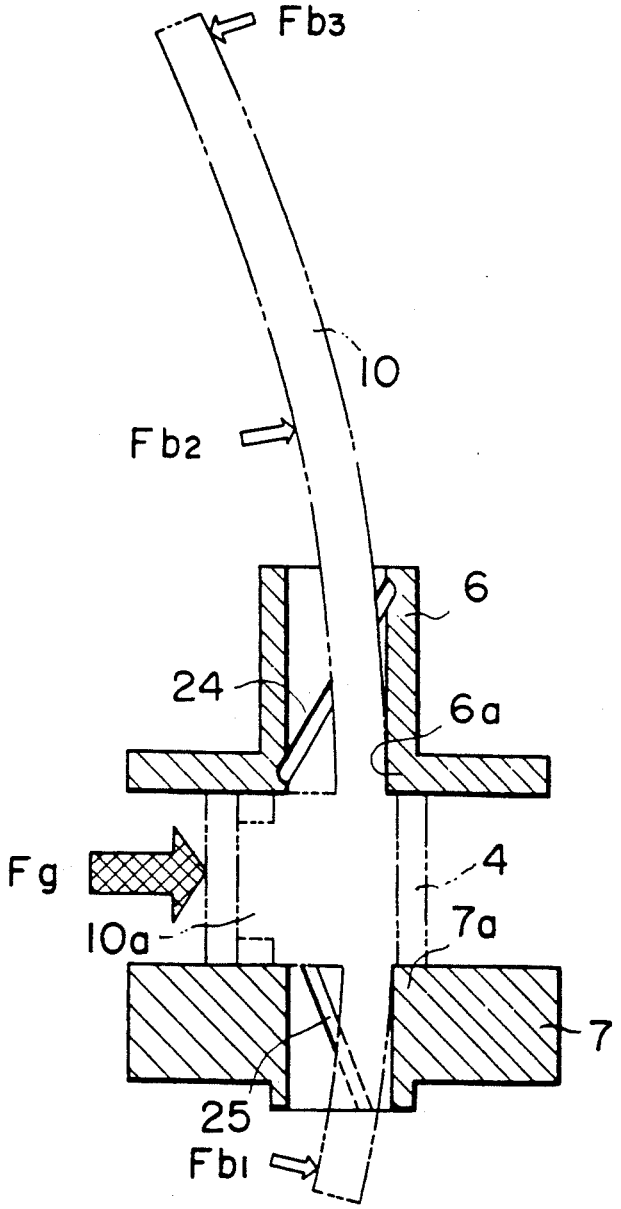
FIG. 8 is a view used to explain the deflection mode of the crank shaft during a low-speed operation of a rotary compressor of a generally-adopted design.

FIG. 8 shows the deflection mode of the crank shaft 10 when gas compression load Fg is applied through the roller 4 to the eccentric portion 10*a* of the crank shaft 10. The gas compression load Fg changes with change in the crank angle. However, the point of application of the load Fg remains substantially constant; namely, it is substantially on the side of the eccentric portion 10*a* to which the axis 0' of the eccentric portion 10*a* is offset from the axis 0 of the crank shaft 10. When the gas compression load Fg is applied in this way, the crank shaft 10 is pushed to one side of each of the shaft holes of the main and auxiliary bearings 6 and 7 and bent in the manner shown in FIG. 8. As a result, load is applied to pressure receiving portions 6*a* and 7*a* of the main and auxiliary bearings 6 and 7. In general, a shaft holes of a bearing is formed therein with an oil groove, such as that denoted at 24 or 25, for guiding the flow of lubricant. Each of the oil grooves 24 and 25 starts from that end of the associated shaft hole which is adjacent to the eccentric portion 10*a* of the crank shaft at a position of the end which is diametrically opposite to the pressure receiving portion 6*a* or 7*a*. The oil groove spirally extends to the other end of the shaft hole. This design is very commonly adopted because, if the starting ends of the oil grooves 24 and 25 are positioned in the pressure receiving portions 6*a* and 7*a*, it is impossible to generate a hydraulic pressure which is high enough to form oil films on the inner peripheral surfaces of the shaft holes of the bearings 6 and 7, thereby causing the shaft and the bearings to come into metal-to-metal contact and become abnormally worn.

The crank shaft 10 is subjected to, in addition to the gas compression load Fg, the centrifugal forces $Fb_1$, $Fb_2$ and $Fb_3$ generated by the first, second and third balancers. When the compressor is operating at a relatively low speed, the load Fg is dominant. At this time, the crank shaft 10 deflects to a configuration shown in FIG. 8.

Figure 16:
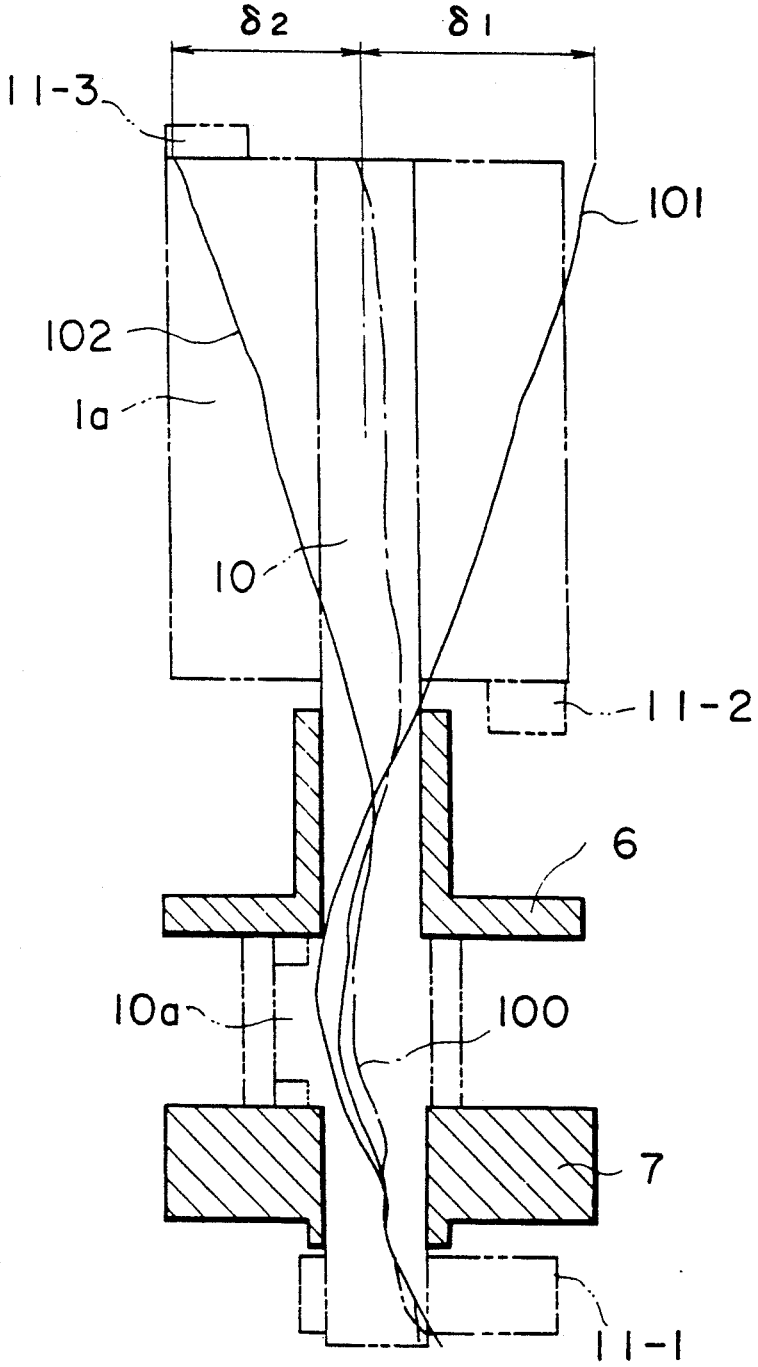
FIG. 16 PRIOR ART
FIG. 16 is a view showing the deflection curves of the crank shaft axis of the conventional compressor.
Figure 17:
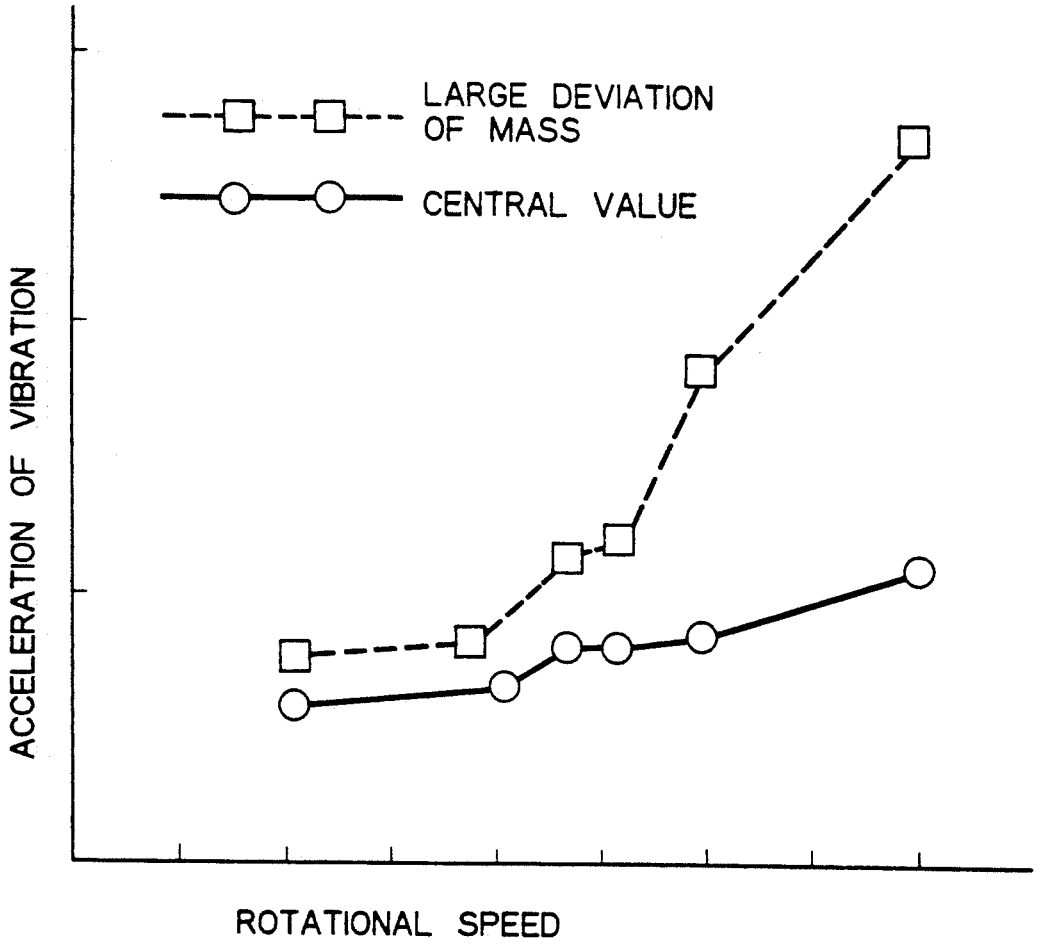
FIG. 17 PRIOR ART
FIG. 17 is similar to FIG. 6 but shows the relationship between the speed of rotation of the crank shaft of the conventional rotary compressor and the vibration acceleration.

The deflection curves 100, 101 and 102, shown in FIG. 16, of the axis of the crank shaft of the prior art result form the centrifugal forces $Fb_1$, $Fb_2$ and $Fb_3$ generated by the first, second and third balancers. During a high-speed operation, these centrifugal forces $Fb_1$, $Fb_2$ and $Fb_3$ are dominant. When balance correction is effected as in the embodiments shown in FIGS. 1 to 5, the deflection amount 61 or 62 shown in FIG. 16 can be greatly reduced, as shown in FIG. 7. In this case, the upper end of the rotor shaft 10 deflects by an amount of 6*a* to the same side as the eccentric portion 10*a* of the crank shaft, as indicated by the deflection curve 102*a*, and by an amount of δb to the side opposite to the crank shaft eccentric portion 10*a*, as indicated by the deflection curve 101*a*.

Figure 9:
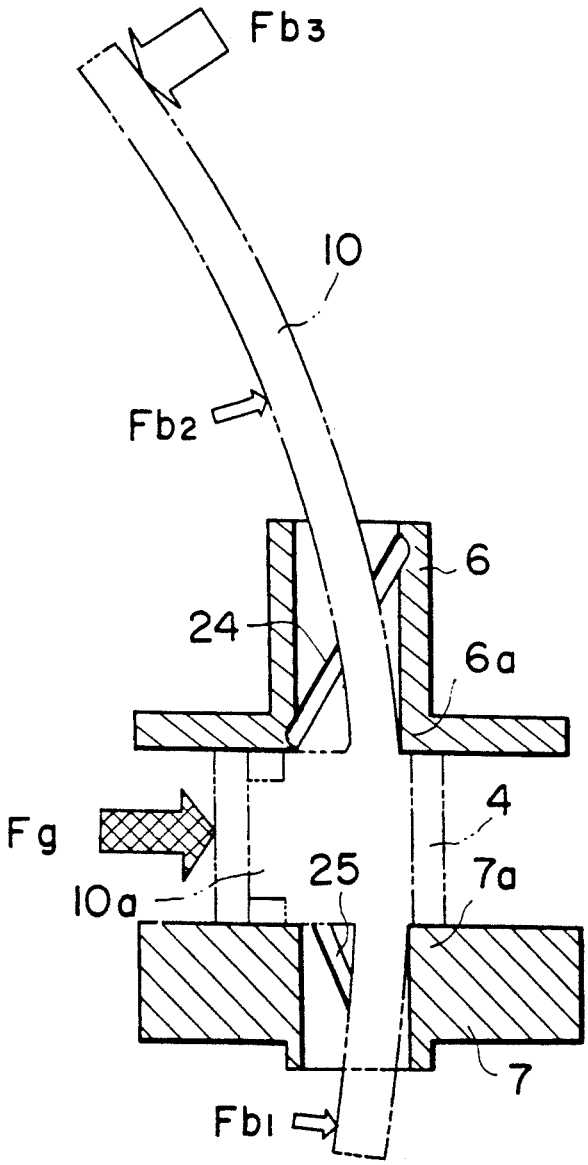
FIGS. 9 and 10 are views used to explain the deflection modes of the crank shaft during a high-speed operation of the rotary compressor of the generally-adopted design.

FIG. 9 shows the deflected configuration of the crank shaft 10 during high-speed operation. When gas compression load Fg is applied, the crank shaft 10 deflects in the same direction as the deflection curve 102*a* (see FIG. 7). At this time, since the crank shaft 10 is positioned on or bent toward the side remote from the starting ends of the oil grooves 24 and 25, no problem arises concerning lubrication reliability.

Figure 10:
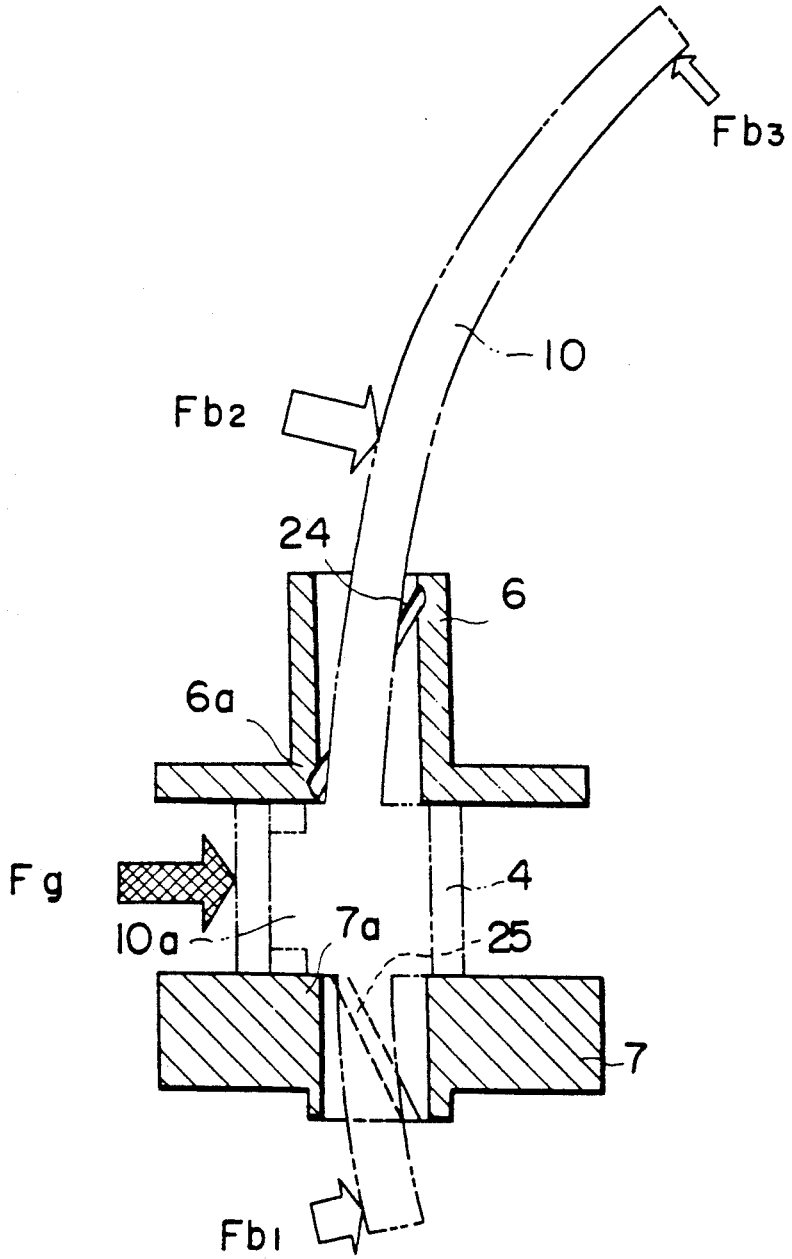

On the other hand, shown in FIG. 10 is the state in which, during high-speed operation, the crank shaft 10 is deflected in the same direction as the deflection curve 101*a* when gas compression load Fg is applied. At this time, the crank shaft 10 is positioned, within the shaft holes of the main and auxiliary bearings 6 and 7, close to the starting ends of the oil grooves 24 and 25. This causes the pressure receiving portions 6*a* and 7*a* of the bearings 6 and 7 to be located on the starting ends of the oil grooves 24 and 24, thereby making it difficult to effect a good lubrication, with the result that the crank shaft and the bearings are subjected to abnormal wears.

Figure 11:
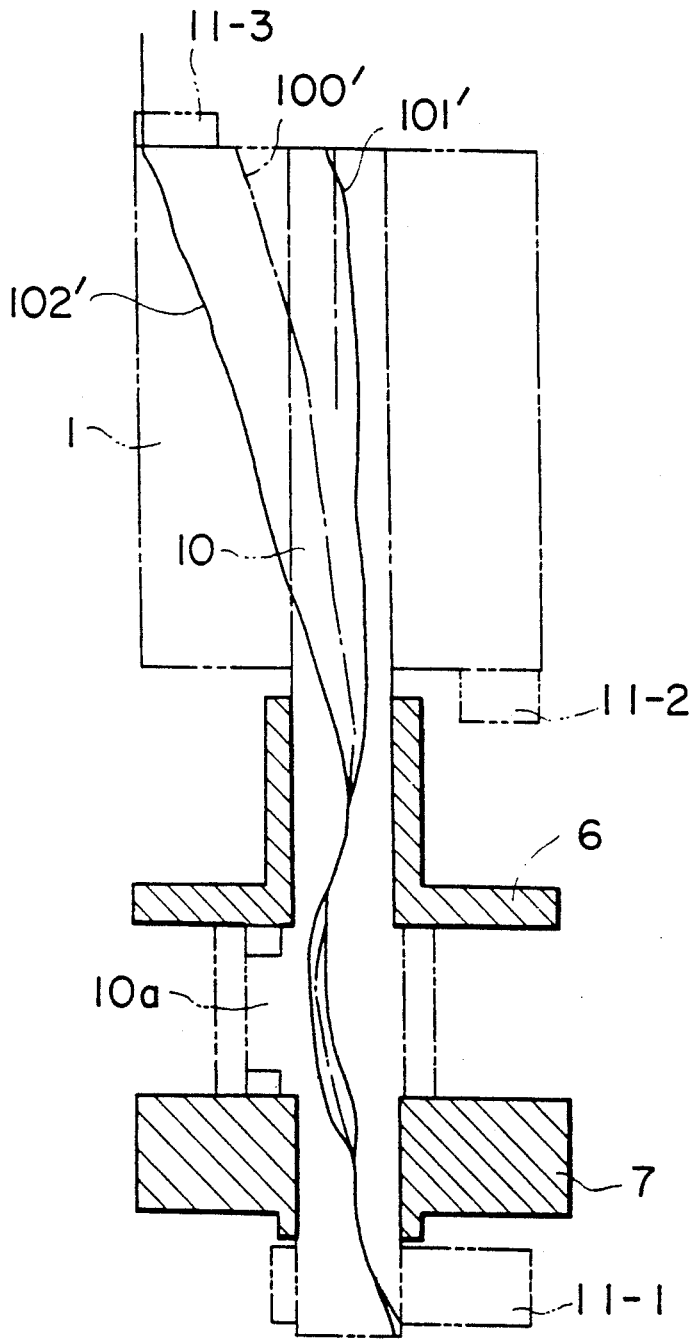
FIG. 11 is a view showing the deflection curves of the axis of the crank shaft whose balance is corrected.

In order to avoid this problem, the set values of the balance amounts (MR) should preferably be slightly shifted from the calculated values in such a manner that, as indicated by the axis deflection curves 100', 101' and 102' shown in FIG. 11, the axis of the crank shaft 10 deflects on the same side as the crank shaft eccentric portion 10*a* during its high-speed rotation. More specifically, when the set values of the balance amounts (MR) are shifted in this manner, the deflection of the axis indicated by the deflection curves 100*a*, 101*a* and 102*a* shown in FIG. 7 is shifted toward the crank shaft eccentric portion 10*a*, as indicated by the deflection curves 100', 101' and 102' in FIG. 11.

Figure 12:
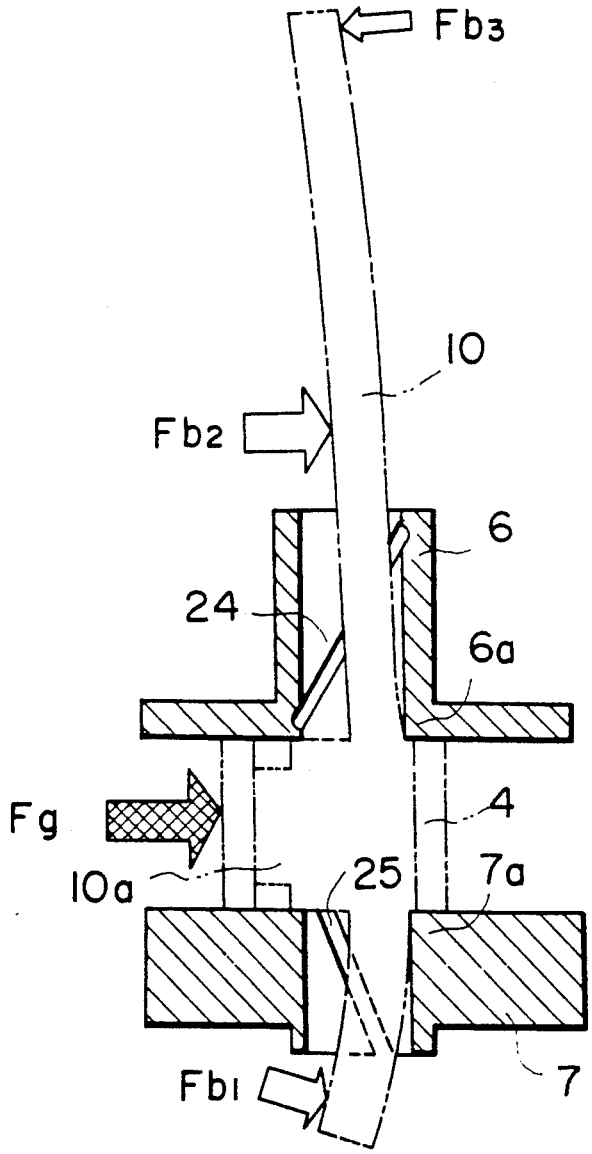
FIG. 12 is a view used to explain the deflection mode of the crank shaft whose balance is corrected.

FIG. 12 shows the state in which, by virtue of the shift of the set values of the balance amount (MR), the crank shaft 10 is deflected in the same direction as the deflection curve 101' (see FIG. 11) when the gas compression load Fg is applied during high-speed operation. In this state, the crank shaft 10 does not move, within the shaft holes of the main and auxiliary bearings 6 and 7, toward the starting ends of the oil grooves 24 and 25, thereby preventing the pressure receiving portions 6*a* and 7*a* from overlapping with the starting ends of the oil grooves 24 and 25.

In order to shift the deflection curves to those shown in FIGS. 11 and 12, it has been ascertained from experiments that, relative to respective balance amounts (MR) calculated by the equations (4), (5) and (6) above, $M_1R_1$ is increased by about 6%, $M_2R_2$ is increased by about 6%, and $M_3R_3$ is increased by about 32%, and the thus obtained values are adopted as the set values. Thus, the balance amounts of the first, second, and third balancers 11-1, 11-2 and 11-3 are set at values greater than the calculated values of the balance amounts (MR) which assure the 100% achievement of the balance in forces, the balance in moments and the balance in the primary vibration mode. With this arrangement, it is possible to prevent abnormal wear of the crank shaft and the bearings, while effectively preventing rapid increase in the vibration acceleration of the crank shaft.

What is claimed is:

1. A rotary compressor comprising:

an electric motor having a rotor;

a compressing mechanism;

a crankshaft connecting said electric motor and said compressing mechanism together and having a first end connected to said rotor and a second end extending through said compression mechanism;

a closed housing accommodating said electric motor, said compressing mechanism and said crankshaft;

said compressing mechanism having a cylinder block formed therein with a cylinder bore, a rolling piston rotatably mounted on an eccentric portion of said crankshaft which is positioned in said cylinder bore, a vane reciprocally movable by the rotation of said rolling piston, and main and auxiliary bearings closing the ends of said cylinder bore and rotatably supporting said crankshaft;

said main and auxiliary bearings having shaft holes through which said crankshaft rotatably extends, an inner peripheral surface of each of said shaft holes being formed therein with an oil groove for lubricant, said oil groove extending from an end of the shaft hole adjacent to said eccentric portion of said crankshaft to an opposite end of the shaft hole;

balancer means for balancing forces generated by eccentric rotation of said crankshaft;

said balancer means comprising a first balancer mounted on said second end of said crankshaft, a second balancer mounted on a first end of said rotor of said electric motor remote from said compressing mechanism, and a third balancer mounted on a second end of said rotor of said electric motor adjacent to said compressing mechanism;

said first, second and third balancers being so disposed in relation to said eccentric portion of said crankshaft that, during a compressor operation, balancing centrifugal forces act on said first and second balancers in a direction opposite to a direction in which an unbalanced centrifugal force acts on said eccentric portion of said crankshaft while a balancing centrifugal force acts on said third balancer in the same direction as that of the unbalanced centrifugal force on said crankshaft eccentric portion;

small holes formed in at least said second and third balancer for enabling a fine adjustment of masses of said second and third balancers; and wherein the balancer amounts for said first, second and third balancers are set at balance amounts greater by a predetermined value than balance amounts that are calculated to substantially complete achievement of balance in forces, balance in moments and balance in primary vibration mode, said predetermined value being such that said crank shaft is allowed to deflect, in the shaft holes, away from end portions of said oil grooves adjacent to said eccentric portion of said crank shaft.

2. A rotary compressor according to claim 1, wherein the mass of said balancer means is finely adjusted such manner that the deviation of the mass of the balancer for said rotor from the value set for the rotor balancer is not more than ±3%.

* * * * *